US005870304A

United States Patent [19]

Yasui

[11] Patent Number: 5,870,304

[45] Date of Patent: Feb. 9, 1999

[54] METHOD FOR DETERMINING THE PROPER PROGRESS OF A SUPERPLASTIC FORMING PROCESS

[75] Inventor: Ken K. Yasui, Huntington Beach, Calif.

[73] Assignee: McDonnell Douglas Corporation, Huntington Beach, Calif.

[21] Appl. No.: 696,553

[22] Filed: Aug. 14, 1996

[51] Int. Cl.[6] ..... G06F 19/00; B21D 26/02

[52] U.S. Cl. ..... 364/472.02; 72/60; 72/709

[58] Field of Search ..... 364/152, 153, 364/164, 165, 472.02, 472.09, 509, 510; 72/20.1, 38, 60, 342.2, 364, 709

[56] References Cited

U.S. PATENT DOCUMENTS

| | | | |
|---|---|---|---|
| 4,087,037 | 5/1978 | Schisi et al. | 72/63 |
| 4,217,397 | 8/1980 | Hayase et al. | 428/59 |
| 4,233,831 | 11/1980 | Hamilton et al. | 72/60 |
| 4,708,008 | 11/1987 | Yasui et al. | 72/60 |
| 4,901,552 | 2/1990 | Ginty et al. | 72/60 |
| 5,129,248 | 7/1992 | Yasui | 72/60 |
| 5,309,747 | 5/1994 | Yasui | 72/60 |
| 5,689,987 | 11/1997 | Yasui | 72/60 |

*Primary Examiner*—Paul P. Gordon
*Attorney, Agent, or Firm*—Bell Seltzer Intellectual Property Law Group of Alston & Bird LLP

[57] ABSTRACT

A method of determining the progress of a superplastic formation process that uses controlled gas-mass flow rate of inert gas to form a part from generally one or more sheets of superplastically formable material, a process that may include selective diffusion bonding of the sheets together. The method includes using the expected initial conditions of the process to calculate a family of constant volume curves plotted on a graph of pressure versus cumulative gas-mass and then comparing the actual pressure and cumulative gas-mass that occurs during the process to determine the health of the process and to determine when the process has successfully completed. The comparison may be performed manually or automatically with a computer which has been programmed to characteristic and non-characteristic progress curve portions.

20 Claims, 5 Drawing Sheets

METHOD FOR DETERMINING THE PROPER PROGRESS OF A SUPERPLASTIC FORMING PROCESS

FIELD OF THE INVENTION

This invention relates to the field of metal forming and, more particularly, to the forming and diffusion bonding of metals, which exhibit superplastic characteristics, with a controlled gas-mass flow whose actual cumulative gas-mass is compared to theoretical cumulative gas-mass to determine if the process is proceeding properly.

BACKGROUND OF THE INVENTION

Superplasticity is the characteristic demonstrated by certain metals which exhibit extremely high plasticity. They develop high tensile elongations with minimum necking when deformed within specific temperature ranges and limited strain rate ranges. The methods used to form and in some cases diffusion bond superplastic materials capitalize on these characteristic and typically employ gas pressure to form sheet material into or against a configurational die in order to form the part. Diffusion bonding is frequently associated with the process. U.S. Pat. No. 3,340,101 to D. S. Fields, Jr. et al.; U.S. Pat. No. 4,117,970 to Hamilton et al.; U.S. Pat. No. 4,233,829 to Hamilton et al.; and U.S. Pat. No. 4,217,397 to Hayase et al. are all basic patents, with various degrees of complexity, relating to superplastic forming. All of these references teach a process which attempts to control stress, and thereby strain, by controlling the pressure in the forming process versus time.

Exceptions to controlling forming rates by controlling pressure versus time are taught in U.S. Pat. No. 4,708,008 to Yasui et al. and U.S. Pat. No. 5,129,248 to Yasui. Yasui et al. teaches measuring and controlling the volume displaced by the blank being formed so as to measure total strain or surface area increase of the blank while Yasui teaches an apparatus and method for controlling superplastic forming processes by measuring and controlling the gas mass flow rate of the gas displacing the blank being formed.

U.S. Pat. No. 4,489,579 to Daime et al. also teaches controlling the process by controlling pressure versus time, but also teaches additional devices for monitoring the forming rate by providing a tube which penetrates the die and engages a portion of the blank to be formed. As the blank is formed, the tube advances through the die directly as that portion of the blank is formed. Means are also provided to produce a signal at predetermined amounts of advancement of the tube and, further, electrical contacts are provided at recess angles of the die and the switch is closed when the blank being formed, it provides for monitoring the forming step which allows the operator to evaluate the development process of the part. However, it is not very practical to have a sliding rue probe with the associated geometric disturbance at the contact point nor is it practical to provide electrical instrumentation in this harsh environment.

Excessive strain rates cause rupture and must be avoided in the forming process. In order to understand excessive strain rates it is necessary to understand the relationship between the variables in superplastic forming which are represented by the classic equation $$\sigma = K\dot{\epsilon}m$$

where m is the strain rate sensitivity, $\sigma$ is stress, $\dot{\epsilon}$ is strain rate, and K is a constant.

In the absence of strain hardening, the higher the value of m, the higher the tensile elongation. Solving the classic equation for m, $$m = \frac{\ln\sigma - \ln K}{\ln\dot{\epsilon}}$$

In addition to strain rate, the value of m is also a function of temperature and microstructure of the material. The uniformity of the thinning under biaxial stress conditions also correlates with the value of m. For maximum deformation stability, superplastic forming is optimally performed at or near the strain rate that produces the maximum allowable strain rate sensitivity. However, because the strain rate sensitivity, m, varies with stress as well as temperature and microstructure, m constantly varies during a forming process.

Furthermore, the strain rate varies at different instances of time on different portions of the formation inasmuch as stress levels are non-uniform. The more complex the part, the more variation there is, and, therefore, strain rate differs over the various elements of the formation. Since strain rate, stress, temperature and microstructure are all interdependent and varying during the process, the relationship is theoretical. As a practical matter, there is no predictable relationship that can be controlled so as to form all portions of complex parts at the optimum strain rate sensitivity and therefore the optimum strain rates. However, the artisan can plot strain rate sensitivity (m) against strain rate ($\dot{\epsilon}$) and stress ($\sigma$) against strain rate ($\dot{\epsilon}$) and establish the best compromise ranges to be caused as guides. Prior to Yasui, those skilled in the art had to select and control those portions of the formation, which are more critical to successful forming while maintaining all other portions at the best or less than the best strain rates which necessary becomes the overall optimum rate.

This was further complicated for deep forming, which requires forming pressure reduction due to the higher thinning rate of the material, if during the forgoing process, the blank was not be exactly where it is thought to be at any given time in the forming process.

By controlling the process with either pressure or perhaps volume alone, only one of the variables in Boyle's Law $$\frac{P_1 \times V_1}{T_1} = \frac{P_2 \times V_2}{T_2}$$

(where P, V, and T represent pressure, volume, and temperature, respectively) was used to control the process. Yasui found that the process was much more stable when instead of controlling pressure which was the accepted practice at the time, the mass of gas used to form was controlled. The stability of this process is due to the recognition that if a controlled mass rate is introduced, when the forming blank is being strained too slowly, the pressure will build up until the applied stress increases to increase the strain rate. When the blank is forming too fast, the pressure drops or at least its rate of increase diminishes to slow down the strain rate due to volume increase. However there has been a need to monitor superplastic forming, or superplastic forming and diffusion bonding processes for early detection of departure from the desired process, so that corrections can be made before the forming part is ruined.

SUMMARY OF THE INVENTION

This invention teaches monitoring a superplastic forming process wherein the gas-mass flow of the forming gas is controlled as described by Yasui in U.S. Pat. No. 5,129,248. A chart or data base is prepared using expected initial conditions of volumes, temperature, gas constant, and pressure to develop curves of constant volume on a graph of pressure versus cumulative gas-mass. The actual pressures and cumulative gas-mass is plotted and compared to the constant volume curves. Departures from the desired process show up as characteristic abnormal places in the plotted pressure curve, which allow the process to be corrected and continued. In addition, the plotted pressure curves provide information as to the progress of the process including when it is complete. The observation of the departures and corrective action normally are manual for experimental parts or small production runs, or automatic using a personal computer with neural net programming and interface cards for making the needed changes to the process, usually by adjusting the gas-mass flow rate and/or the temperature when large production runs are involved. The plotting of the actual pressures and cumulative gas-mass and the constant volume curves can be done automatically on a CRT for manual observation. Usually the initial gas-mass flow rate is chosen empirically according to the size and shape complexity, and then it is gradually increased with each identical part until a process departure is observed, so that the parts are made as fast as safely possible. With automatic control, it is possible to provide variation in gas-mass flow rate during the formation of a part to further speed up the process during times when volume is increasing at a high rate because of the geometry of the part. Since the monitoring of the present invention allows an artisan to know the progress of the forming process, variable rate gas-mass forming is also possible manually. However, the manual attention required is rarely worth the cost saving except for experimental parts.

It therefore is an object of the present invention to provide a method for monitoring superplastic forming processes using controlled gas-mass forming, especially those forming processes where face sheets generally surround the core sheets to obstruct access to the core sheets.

Another object of this invention to provide information as to the health of a superplastic forming process without requiring invasive probes and electrical contacts.

Another object is to provide an improvement to superplastic forming processes that allow optimum formation speed.

Another object is to provide an improvement to superplastic forming processes that requires no special tools, it being useful with conventional forming tools.

These and other objects and advantages of the present invention will become apparent to those skilled in the art after considering the following detailed specification, together with the accompanying drawings wherein:

DETAILED DESCRIPTION OF THE INVENTION

Figure 1:
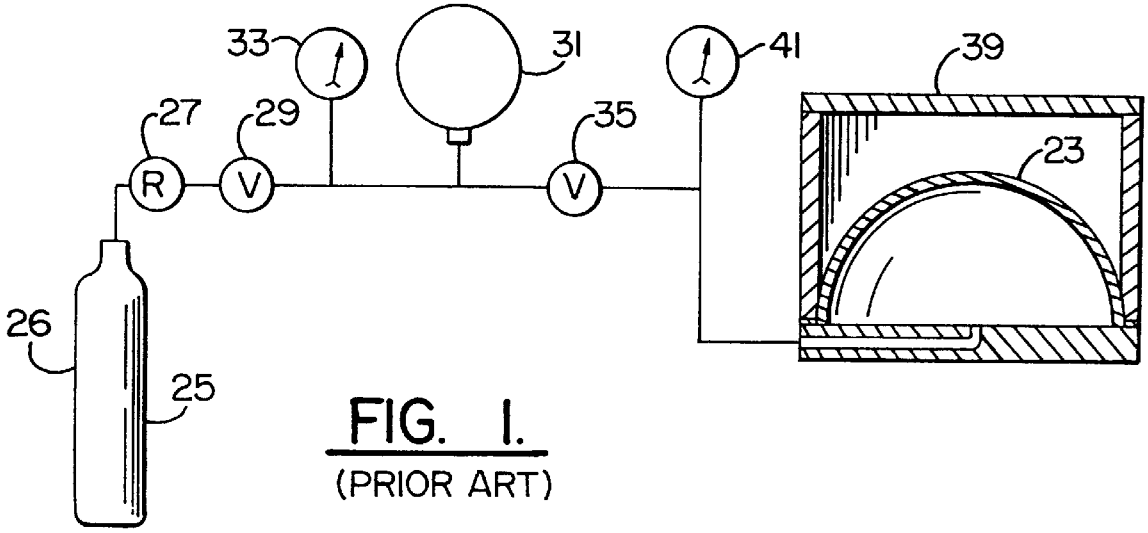
FIG. 1. (PRIOR ART)
FIG. 1 schematically shows the prior art Yasui forming apparatus and the associated accumulator type controller device.

FIG. 1 is a schematic of a simple prior art apparatus, which is used to control the mass flow of the inert gas used in superplastically forming a single sheet 23. The source 25 of the gas, usually an argon gas bottle 26, is fed through a pressure regulator 27 followed by a shut-off valve 29. When the shutoff valve 29 is open, the inert gas is fed to an accumulator 31, which is sized according to the cavity volume of the part to be formed. A pressure gage 33 is used to read the pressure in the accumulator 31. The smaller the accumulator volume, the more precisely the accumulator pressure can be controlled.

A throttling valve 35 is used to control the gas flow from the accumulator 31 through the base 37 of configurational die 39, which in this example is a simple cylindrical die against the sheet 23. The forming pressure is indicated on the pressure gage 41 downstream of the valve 35. The accumulator 31 is initially pressurized to a predetermined pressure by opening valve 29 and having the pressure regulator set at a predetermined controlling pressure. Once the accumulator 31 is charged to the predetermined pressure at a known temperature and volume, the mass of the gas in the accumulator 31 is readily calculated. The valve 29 is closed and the gas in accumulator 31 is introduced through the valve 35 into the die 39 at a predetermined rate until the pressure falls to a precalcuated minimum pressure, thereby controlling the gas-mass flow in predetermined amounts in short intervals with minimal pressure change. When the accumulator pressure drops to the predicted level, valve 35 is closed and valve 29 is opened to re-charge the accumulator 13 to the predetermined pressure and thereby a predetermined mass. The procedure is then repeated as many times as is required to assure full formation of the sheet 23 into the cylindrical configuration of the die 39.

Figure 2:
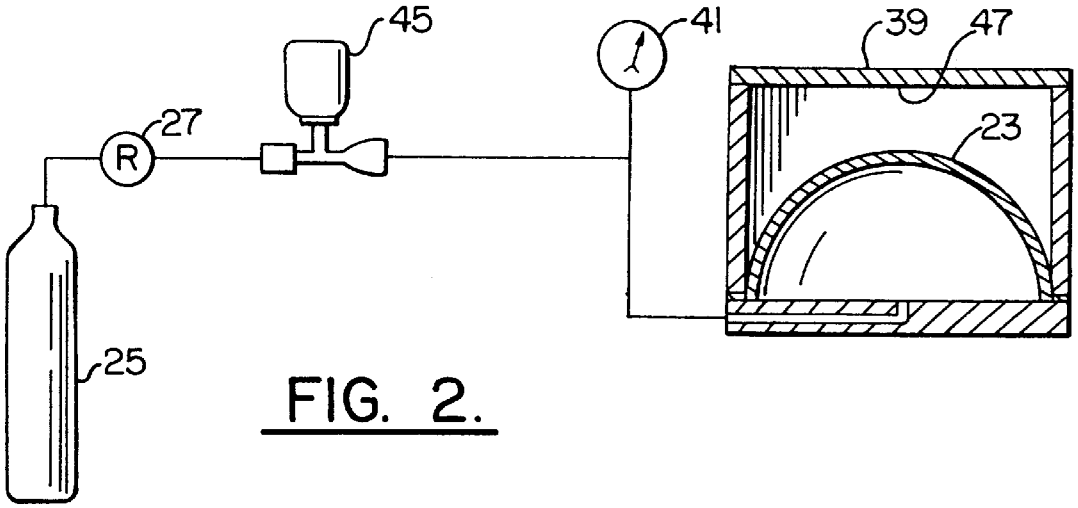
FIG. 2 is an alternate controlling device using a gas mass flow meter.

As shown in FIG. 2, a mass flow controller 45 may replace the accumulator 31, the shut-off valve 29, and throttling valve 35 so that the process can be controlled directly from the regulator 27. Suitable mass flow controllers for this purpose are commercially available. The specific model required is determined by the mass flow range required to form a specific specimen. A more sophisticated system may be provided with a neural net program running in a personal computer and an electrically controlled mass flow controller.

Heretofore, no matter what method was used to control the pressure of the forming gas, initial analytical steps were required. The relationship between stress, $\sigma$, and strain rate, $\dot{\epsilon}$, at the forming temperature for any given material had be established either analytically or experimentally. Using this data total deformation of the part being formed was approximated by analyzing the geometry of the particular part being formed as a function of applied stress. Unquestionably, a very accurate stress versus time curve can usually be established computationally for even very complex structures. However, these analyses are very time consuming in light of the many variables and is subject to deviations in the material and process parameters. The substantial benefit of gas mass flow control as compared to pressure control was realized in the minimum amount of analysis required.

Figure 3A:
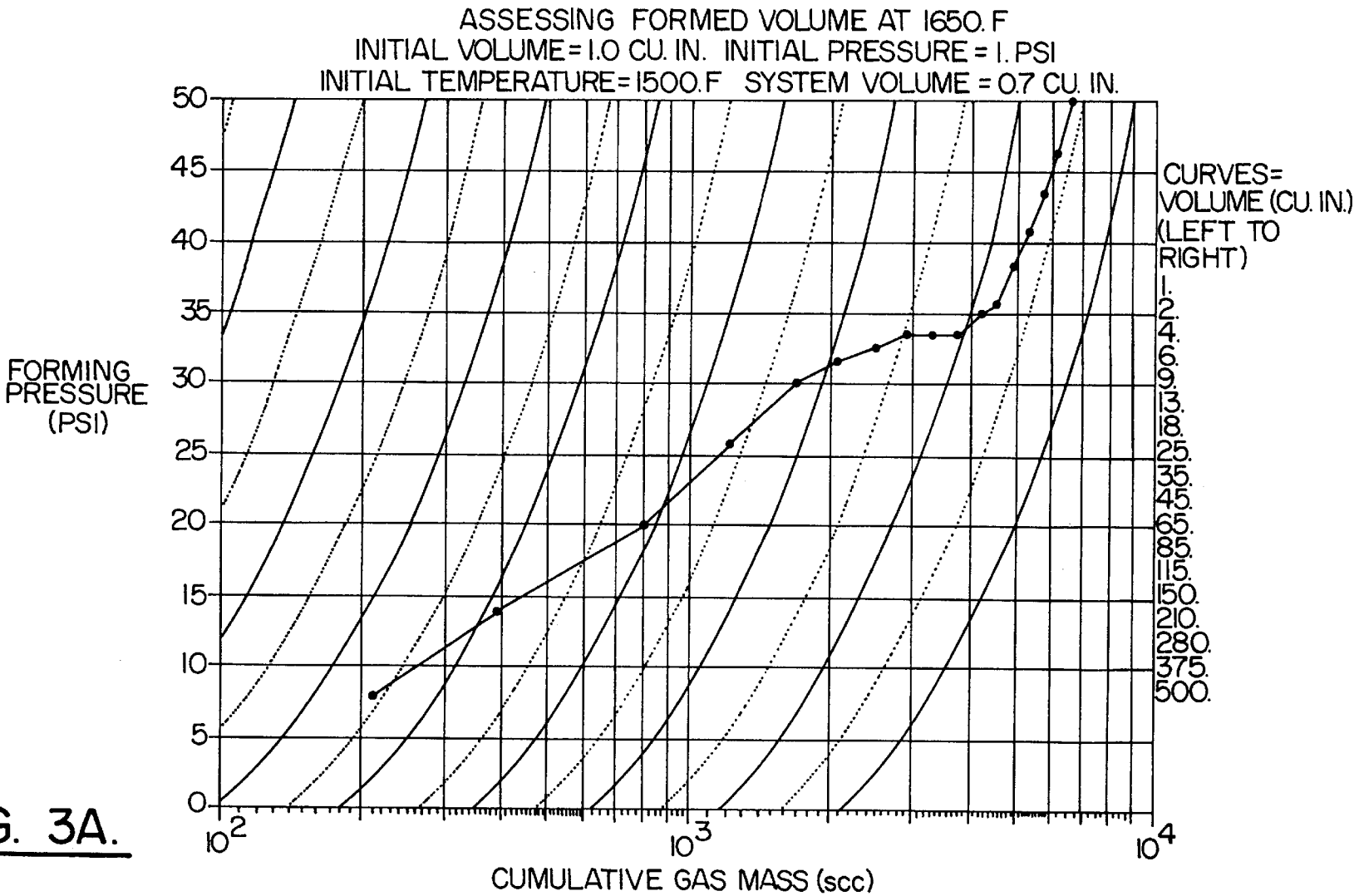
FIG. 3A is a chart or data base of constant volume curves on a graph of forming pressure versus a logarithmic scale of cumulative gas-mass with a typical forming plot for a cylindrically shaped part.

In the present invention the pre-analysis is practically eliminated by generating a chart or data base of constant volume curves on a plot of forming pressure versus a logarithmic scale of cumulative gas-mass as shown in FIG. 3A. The chart is an expression of the general gas law $$pv=mRT$$

where m is the mass of gas at absolute temperature, T, and R is a constant that depends on the units. The chart of FIG. 3A is easily calculated with a simple program and a desktop computer from inputs of initial volume, pressure, temperature and process system volume, and final maximum forming volume and forming temperature. In the case of FIG. 3A, the initial volume of the part is 1.0 $in^3$, initial pressure is 1.0 psi, initial temperature is 1500° F. and the system for providing the gas has a volume of 0.7 $in^3$. The volume of the die was four hundred seventy $in^3$ while the final volume of the part was about three hundred sixty $in^3$. The difference is due to the volume of the part material and because the test part was not fully formed into the mold, allowing the removal of the part with less effort.

Figure 3B:
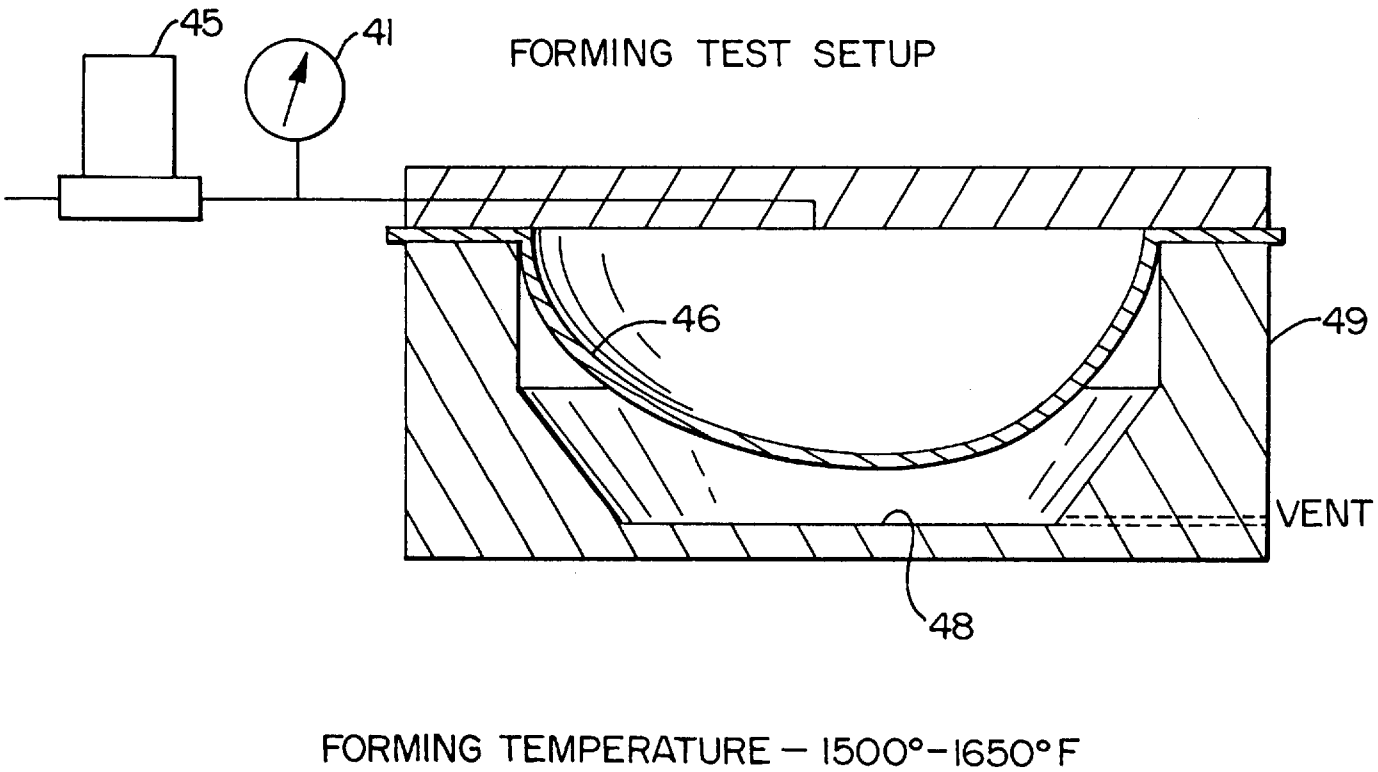
FIG. 3B is a cross-sectional view through a die and a single sheet part as the part is being formed, for the process documented by the plot of FIG. 3A.

The pressure and cumulative gas-mass is then plotted either manually or automatically and the resultant curve is compared to the ideal constant volume curves. The expected final volume of a part is usually easily calculated, especially if computer designed. In FIG. 3A, for a single sheet part 46 shown in formation in FIG. 3B, the rise in pressure increase rate starting at about 800 scc is due to increasing stress before the desired forming temperature of 1650° F. was reached. At about 1700 scc, the temperature became high enough that the pressure rate increase began to decrease until the substantial contact of the sheet 47 to the bottom surface 48 of the die 49 occurred, which can be seen by the change of slope at about 3800 scc. The part would have reached its fully formed shape at about 100 psi where the plot would have paralleled the three hundred seventy five $in^3$ line at about four hundred and fifty $in^3$.

Figure 4:
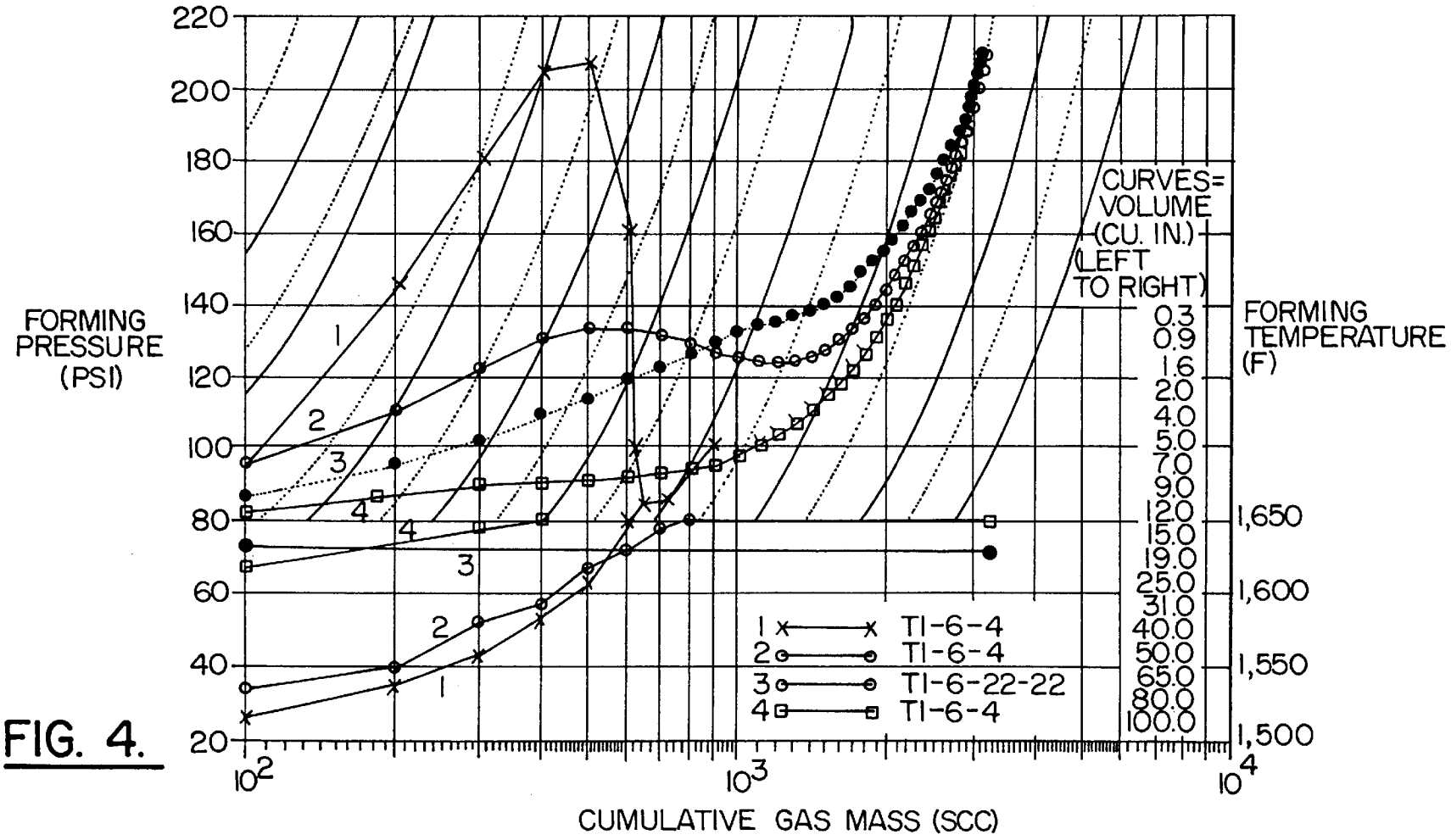
FIG. 4 is a chart similar to FIG. 3A for a four sheet part formed at four different conditions.
Figure 5A:
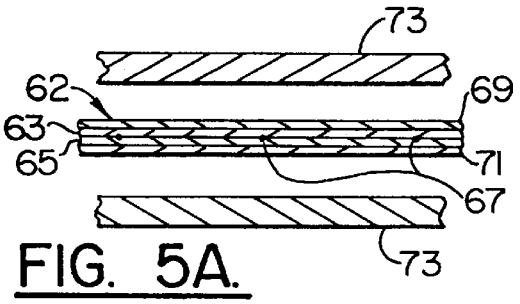
FIGS. 5A, 5B, 5C, and 5D are cross-sectional views of the four sheet part whose curves are in FIG. 4.
Figure 5B:
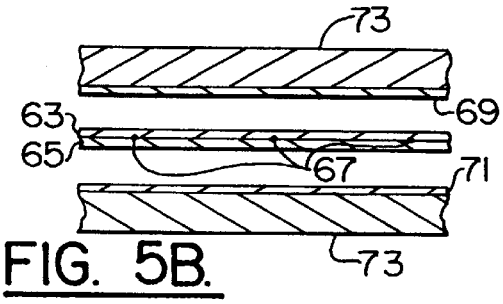
Figure 5C:
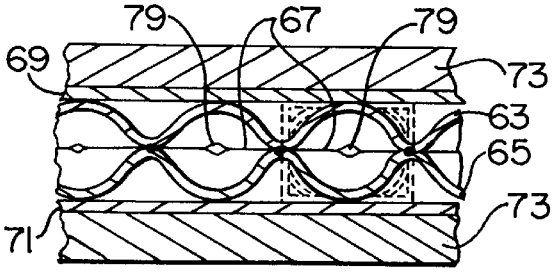
Figure 5D:
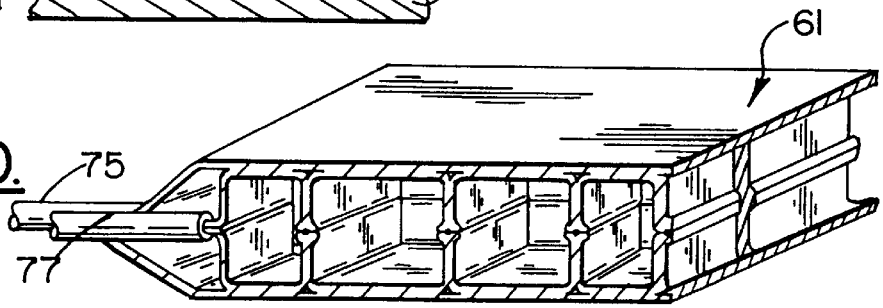

In FIG. 4, which also plots forming temperature against cumulative gas-mass, four different process runs with the same forming die, fabricating a four sheet SPF/DB part 61, such as shown being formed in FIGS. 5A, 5B, 5C, and 5D, are documented. The part 61 starts as a blank 62 including a pair of core sheets 63 and 65 connected together by a cross hatch of interrupted weld beads 67 positioned between two face sheets 69 and 71 in a hot die 73. The face sheets 69 and 71 are expanded against the die 73 by pressure introduced through tube 75 until they expand against the die 73 (FIG. 5B). Thereafter the gas-mass forming commences with inert gas being introduced through tube 77 so that the core sheets 63 and 65 expand (FIG. 5C) out against the face sheets 69 and 71. The resultant part 61 before the pressure tubes have been removed is shown in FIG. 5D.

In run 1, the temperature of formation was low for the early time of the formation process and passages 79 within the part blank 62 to distribute the gas from tube 77 apparently were obstructed. Note how the pressure reached over 200 psi and yet the part was clearly not formed because only about five hundred standard cubic centimeters (scc), which are units of mass, of inert gas had been introduced. As a corrective measure, the gas-mass flow was stopped for about five minutes while the temperature was elevated. When the temperature was elevated to over 1600° F., the internal passages 79 became unobstructed and the pressure dropped back to the expected pressure. Gas-mass flow was resumed when the pressure decreased sufficiently and thereafter run 1 duplicated run 4, where the temperature was close to 1650° F. from the start of the formation process and the passages 79 were properly open from the start. Note how temperature sensitive the process can be from run 2 where a much lower pressure spike occurred when forming was started during heat up but at a slightly higher temperature. Run 3 was titanium alloy Ti-6-22-22 instead of Ti-6-4 and occurred at a constant temperature of 1630° F., so the formation pressures are generally higher, but controlled. As the final volume of the part 61 was reached (about 52 $cc^3$) all of the plots of the runs became asymptotic to the family of constant volume curves, indicating that no further formation was occurring. Thus, the plot provides an indication of the health of the process as it proceeds, of various transition points during the process, and of normal completion without requiring extensive calculations as were previously required. For production purposes, the monitoring process can be converted into a graph of time versus percentage completion once the proper process parameters have been set. The production personnel then look to see that the part is forming at the proper rate against the clock, and take corrective action only if the part is forming too fast or too slow.

Figure 6:
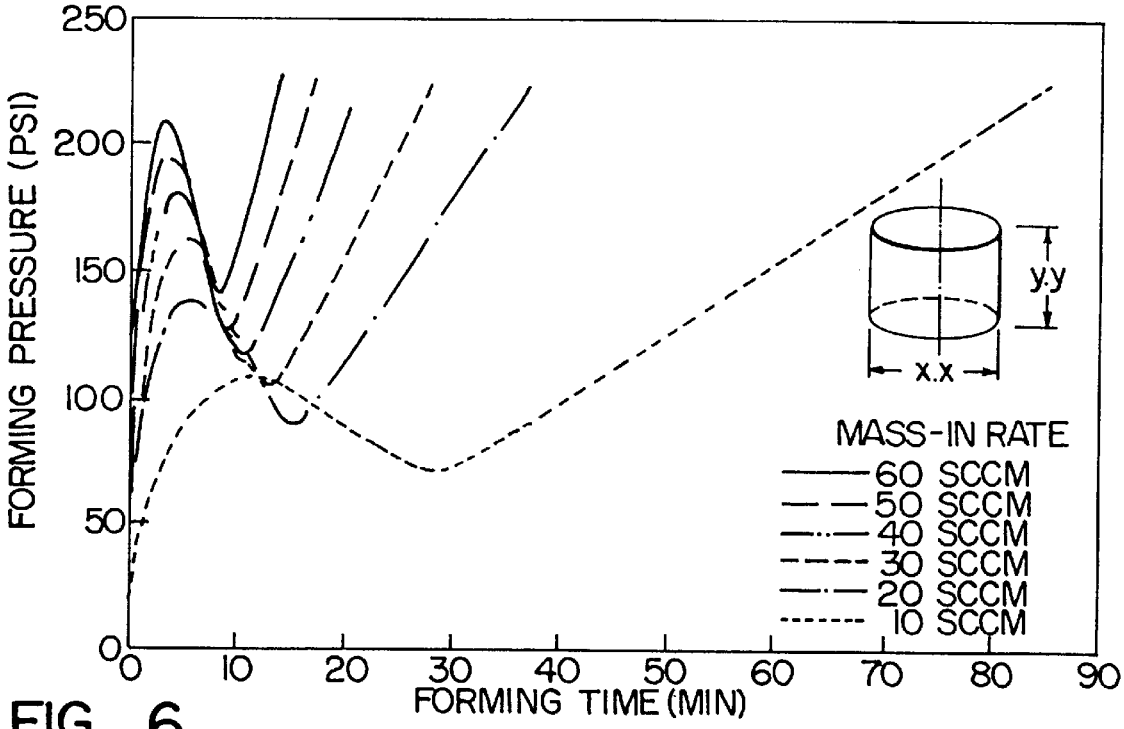
FIG. 6 shows a graph of characteristic pressure curves for the part of FIGS. 1 and 2 formed at different gas-mass flow rates.

FIG. 6 is a graph of characteristic pressure curves for the part of FIGS. 1 and 2 formed at different gas-mass flow rates. Note how the maximum pressure increases with increasing flow rate and of course how the length of the process is reduced by faster flow rates. These characteristic curves can also be used by production personnel to monitor the production process.

Thus, there has been shown novel SPF/DB monitoring methods which fulfill all of the objects and advantages sought therefor. Many changes, alterations, modifications and other uses and applications of the subject invention will become apparent to those skilled in the art after considering the specification together with the accompanying drawings. All such changes, alterations and modifications which do not depart from the spirit and scope of the invention are deemed to be covered by the invention which is limited only by the claims that follow.

I claim:

1. A method for monitoring a superplastic forming process in forming equipment that introduces forming gas at a controlled gas-mass flow rate to deform a blank into one or more dies including:

determining an initial volume of the blank to be formed; determining an initial volume of the forming equipment;

determining an initial temperature at which the blank is to be formed;

determining an initial pressure at which the forming gas is going to be introduced to deform the blank;

calculating a family of curves of constant volume with respect to pressure and gas-mass forming rate from the initial volumes, temperature and pressure using the formula v=mRt/p where m is the mass of gas at absolute temperature, T, p is pressure and R is a constant; and comparing actual pressure/cumulative gas-mass of the process against the family of curves of constant volume to determine completion of the process when the actual pressure/cumulative gas-mass is asymptotic to a curve of the family curves.

2. The method as defined in claim 1 wherein the family of curves of constant volume is compared to the actual pressure/cumulative gas-mass automatically.

3. The method as defined in claim 2 including:

comparing the actual pressure/cumulative gas-mass to an expected characteristic pressure/cumulative gas-mass as the process is in progress to catch process departures as they occur.

4. The method as defined in claim 3 including:

adjusting gas-mass flow rate to return the process to the expected characteristic pressure/cumulative gas-mass.

5. The method as defined in claim 3 including:

adjusting temperature to return the process to the expected characteristic pressure/cumulative gas-mass.

6. The method as defined in claim 3 including:

adjusting gas-mass flow rate and temperature to return the process to the expected characteristic pressure/cumulative gas-mass.

7. The method as defined in claim 2 including:

comparing the actual pressure/cumulative gas-mass to an expected characteristic pressure/cumulative gas-mass as the process is in progress to catch process departures as they occur;

adjusting the gas-mass flow rate up for each successive identical part forming until a process departure is caught; and reducing the gas-mass flow rate to the highest flow rate without a process departure.

8. The method as defined in claim 1 wherein the family of curves of constant volume is compared to the actual pressure/gas-mass rate manually by:

plotting the family of curves and the actual pressure/cumulative gas-mass on a graph of pressure versus the log of the cumulative gas-mass so that conduct of the early portions of the process is amplified.

9. The method as defined in claim 8 including:

comparing the plot actual pressure/cumulative gas-mass to an expected characteristic pressure/cumulative gas-mass curve as the process is in progress to catch process departures as they occur.

10. The method as defined in claim 9 including:

manually adjusting gas-mass flow rate to return the process to the expected characteristic pressure/cumulative gas-mass curve.

11. The method as defined in claim 9 including:

manually adjusting temperature to return the process to the expected characteristic pressure/cumulative gas-mass curve.

12. The method as defined in claim 8 wherein said plotting includes:

displaying the actual pressure/cumulative gas-mass automatically on a CRT with the family of curves of constant volume.

13. The method as defined in claim 1 including:

plotting the actual pressure/cumulative gas-mass curve;

manually comparing an expected characteristic pressure/cumulative gas-mass curve to the actual pressure/cumulative gas-mass curve as the process is in progress to catch process departures as they occur;

adjusting the gas-mass flow rate up for each successive identical part forming until a process departure is caught; and reducing the gas-mass flow rate to the highest flow rate without a process departure.

14. A method for monitoring a superplastic forming process in forming equipment that introduces forming gas at a controlled gas-mass flow rate to deform a blank into one or more dies including;

calculating a family of curves of constant volume with respect to pressure and gas-mass forming rate from initial conditions using the formula $v=mRt/p$ where m is the mass of gas at absolute temperature, T, p is pressure and R is a constant; and comparing actual pressure/cumulative gas-mass of the process against the family of curves of constant volume to determine the progress of the process.

15. The method as defined in claim 14 including:

comparing the actual pressure/cumulative gas-mass of the process to an expected characteristic pressure/cumulative gas-mass of the process as the process is in progress to catch process departures as they occur.

16. The method as defined in claim 15 including:

adjusting gas-mass flow rate to return the process to the expected characteristic pressure/cumulative gas-mass of the process.

17. The method as defined in claim 15 including:

adjusting temperature to return the process to the expected characteristic pressure/cumulative gas-mass thereof.

18. The method as defined in claim 15 including:

comparing the actual pressure/cumulative gas-mass of the process to the expected characteristic pressure/cumulative gas-mass of the process as the process is in progress to catch any process departure as it occurs;

adjusting the gas-mass flow rate up for each successive identical part forming until a process departure is caught; and reducing the gas-mass flow rate to the highest flow rate without a process departure.

19. A method for monitoring a superplastic forming process in forming equipment that introduces forming gas at a controlled gas-mass flow rate to deform a blank into one or more dies including:

calculating a family of curves of constant volume with respect to pressure and gas-mass forming rate from initial conditions using the formula $v=mRt/p$ where m is the mass of gas at absolute temperature, T, p is pressure and R is a constant; and comparing actual pressure/cumulative gas-mass of the process against the family of curves of constant volume to determine completion of the process when the actual pressure/cumulative gas-mass is asymptotic to a curve of the family of curves.

20. The method as defined in claim 19 including:

plotting the actual pressure/cumulative gas-mass curve;

comparing expected characteristic pressure/cumulative gas-mass curve to the actual pressure/cumulative gas-mass curve plotted as the process is in progress to catch process departures as they occur;

adjusting the gas-mass flow rate to return the process to the expected characteristic pressure/cumulative gas-mass thereof; and generating a time versus percentage completion graph for use by production personnel.

* * * * *